United States Patent [19]

Blumenthal et al.

[11] 4,094,153

[45] June 13, 1978

[54] BREAST ROOF SUPPORT SYSTEM FOR LONGWALL MINING

[75] Inventors: Günter Blumenthal, Westerhold; Karlheinz Bohnes; Peter Marr, both of Bochum, all of Germany

[73] Assignee: Bochumer Eisenhütte Heintzmann GmbH & Co., Germany

[21] Appl. No.: 748,911

[22] Filed: Dec. 9, 1976

[30] Foreign Application Priority Data

Oct. 15, 1976 Germany ..... 2646563

[51] Int. Cl.[2] ..... E21D 15/44

[52] U.S. Cl. ..... 61/45 D

[58] Field of Search ..... 61/45 D; 299/31-33; 91/170 MP; 248/357

[56] References Cited

U.S. PATENT DOCUMENTS

| | | | |
|---|---|---|---|
| 3,524,321 | 8/1970 | Wilkenloh et al. | 61/45 D |
| 3,848,420 | 11/1974 | Allen et al. | 61/45 D |
| 4,002,036 | 1/1977 | Jeffrey et al. | 61/45 D |
| 4,010,618 | 3/1977 | Walker et al. | 61/45 D |

*Primary Examiner*—Dennis L. Taylor
*Attorney, Agent, or Firm*—Michael J. Striker

[57] ABSTRACT

In a longwall mining operation the roof of the breast extending laterally from a heading or gangway is supported by at least two pairs of pit props. Each pair is substantially identical, having an elongated upper part and an elongated lower part displaceable away from each other by hydraulic rams. In addition a shield is provided extending vertically between the upper and lower parts of each prop at the upstream end of the prop turned toward the stowage area. In addition the props furthest from the mine are substantially longer than the props closest to the mine and are provided at their ends turned toward the stowage area with side shields forming a closed chamber so as carefully to segregate the gob from the breast. The upper parts of the props are formed of several articulated sections so as to allow these upper parts to conform to the shape of the roof. In addition that prop closest to the mine is provided with laterally extending upwardly pivotal flaps usable to support the roof at the opening between the breast and the mine.

11 Claims, 8 Drawing Figures

II
VI
13
53
41
42
5
52
11
3
12
14
28
44
46
47
7
8
29
17
6
27
16
10
18
19
1
20
21
15
2
A
B
4
9

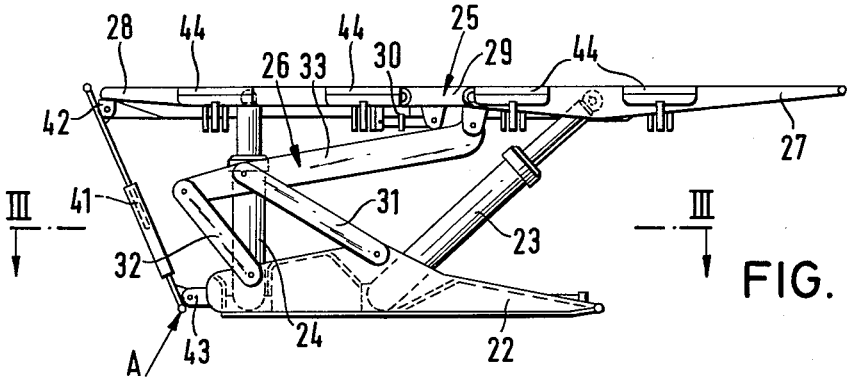
FIG. 2
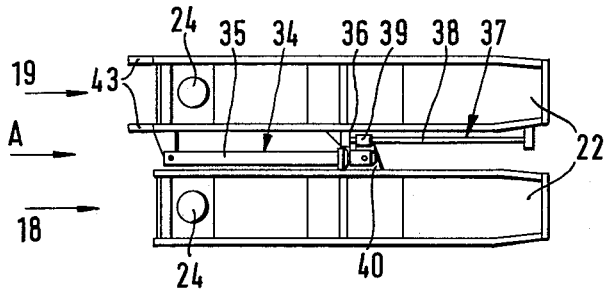
FIG. 3
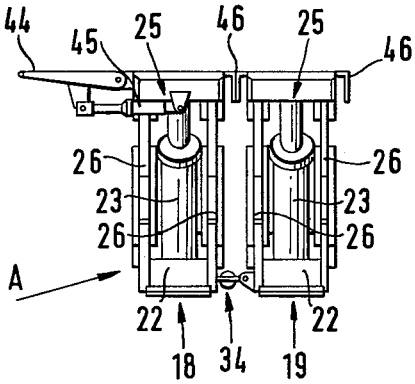
FIG. 4
FIG. 5
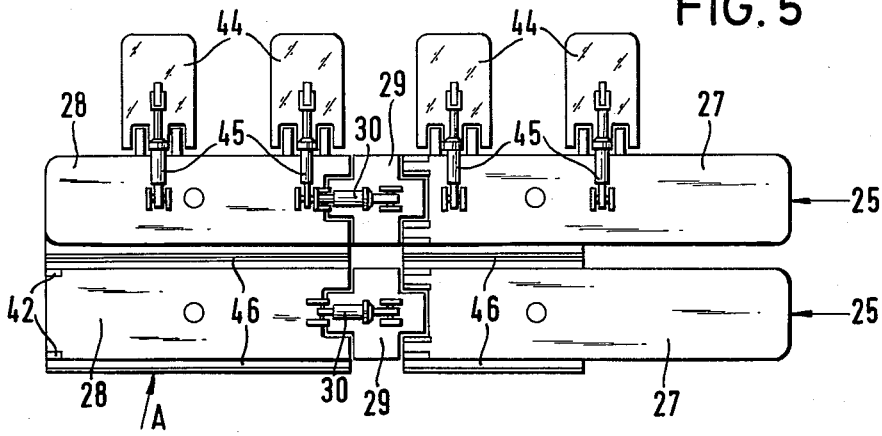

BREAST ROOF SUPPORT SYSTEM FOR LONGWALL MINING

CROSS -REFERENCE TO RELATED APPLICATION:

This application is related to our commonly assigned and copending patent application, Ser. No. 748,912 filed Dec. 9, 1976 and entitled "Roof Prop Apparatus and Method for Longwall Mining."

BACKGROUND OF THE INVENTION

The present invention relates to an apparatus for supporting a mine roof at a seam being worked. More particularly this invention concerns a prop system for supporting the roof of a breast extending laterally from a heading or gangway in a longwall mining operation.

In a longwall mining operation a mine, by which is meant a heading, gangway, or the like, extends along the seam to be worked. The roof of this mine is held up by means of arched props having legs extending down along the sidewalls of the mine and standing on the floor of the mine. In order to work the seam extending along the mine it is necessary to sequentially remove legs of the arches while supporting them with an auxiliary propping apparatus such as described in the above-cited patent application so that it is possible to form a chamber or breast extending laterally from the mine, moving this breast along the mine as the face is worked.

It is necessary to support the roof of the breast during the mining operation at least at the location where the face is being worked. This is typically done by means of a plurality of hydraulically operated pit props which are moved around in the relatively low breast behind the face-working equipment. These props are continuously moved along as the face advances, each prop being periodically lowered somewhat and moved toward the face, then having its upper part pushed against the roof of the breast again while another prop is similarly lowered and advanced.

Although it is customary to provide a relatively sophisticated arrangement for supporting the various arches and carrying the mining equipment and conveying equipment for working the normally coal seam, it is still a standard practice to use individual props at the breast, which props must be painstakingly displaced one-by-one by highly qualified mining personnel. Such a method is relatively expensive in practice and, therefore, increases the cost of the product being mined.

Another disadvantage with the known system is that the mine roof frequently is loosened by the relatively large pit props so that cave-ins and the like can occur. Thus the mine personnel must work with extreme care, and even so it is a frequent occurrence for considerable amounts of rock and the like to fall down in the breast during advance of one of the props.

Another disadvantage of the known system is that the stowage filled in behind the breast as the face is moved along the mine often enters into the props and, indeed, even spills out occasionally into the mine. Furthermore, the dust generated by the cave-ins or collapses which often occur behind the face in the stowage area comes into the breast region and even out into the mine so as greatly to hamper operations.

SUMMARY OF THE INVENTION

It is therefore an object of the present invention to provide an improved prop system for supporting the roof of a breast extending laterally from a mine and having a face side and a stowage side. In accordance with this invention the system comprises a plurality, at least three, of similar props each including a lower floor-engaging part elongated longitudinally generally parallel to the mine and having an end turned toward the face side and another end turned toward the stowage side, a roof-engaging upper part extending generally parallel to the respective lower part and extending at each of its opposite ends past the respective lower part, and means such as a hydraulic ram and scissor or rocker linkage for displacing each upper part upwardly and generally parallel relative to the respective lower part. Furthermore means is provided extending longitudinally between adjacent props for displacing each prop longitudinally relative to an adjacent prop. An upright solid shield, by which is meant a shield having no perforations or throughgoing holes allowing material such as dust to pass through it, is provided on each of the props extending between the respective upper and lower parts at the ends thereof turned toward the stowage side. Another such upright solid shield is provided extending longitudinally between the upper and lower parts of the prop furthest from the mine, at the side of this prop turned away from the mine.

With the system according to the present invention it is therefore possible to step the individual props along the mine in a mechanized and highly efficient manner which does not require the close supervision of more than one person. Furthermore the provision of the shields on the stowage side of the prop assembly and on the side of the assembly turned away from the mine insures that the stowage material remains where it is supposed to be, and prevents dust and the like from entering the breast area where the face is being worked.

In accordance with this invention the upper parts have a transverse width equal to no more than one-third the overall minimum height of the assembly between the top of its upper part and the bottom of its lower part. Thus the area supported by each upper part is relatively limited so that when one upper part is dropped down and the respective prop is stepped relative to the other prop forming a pair with it, only a limited area of the roof is unloaded so that caving-in is unlikely as is corresponding weakening of the roof. Furthermore each upper part is formed of a plurality of hinged-together sections which can be pivoted relative to each other via respective hydraulic cylinders so that it is possible to conform the shape of the upper part to a non-planar or irregular roof.

The upper part closest to the mine is provided in accordance with this invention with a plurality of longitudinally spaced flaps pivotal about horizontal axes and each controlled by a respective hydraulic cylinder. These flaps hold up the roof of the mine at the very edge of the cut where the breast joins the lateral wall of the mine. This region is particularly sensitive to caving-in and may also be supported by further such flaps which mesh or interdigitate with the flaps on the prop and are themselves carried on the apparatus which holds up the mine roof props as described in our above-identified copending patent application.

The shields on the sides of the pit props toward the stowage areas are constituted by telescoping or overlapping metal plates, one carried on each upper part and one on each lower part. Similarly a pair of overlapping metal plates is carried on that prop furthest from the mine on its side turned away from the mine. In this manner the stowage area is neatly partitioned off by the various shields from the working area. Furthermore each of the upper parts of each pair of adjacent props is provided along its longitudinal edge turned toward the other part with sealing elements that insure that dust and the like cannot come down between two adjoining props.

Each prop is provided in accordance with this invention with a rocker or lemniscate linkage connected between its upper and lower parts, and with one or more hydraulic rams which serve to vertically displace the upper part relative to the lower part. The linkage insures that at least a pivot axis carrying one of the sections of the upper part moves in a plane perpendicular to the respective lower part.

According to yet further features of this invention those pairs of props closest to the mine are considerably narrower, but considerably longer than those props furthest therefrom. Furthermore the props closest to the stowage area may be considerably shorter than the props immediately adjacent the mine, as the roof need not be as meticulously shored up in this location as close to the mine.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

BRIEF DESCRIPTION OF THE DRAWINGS:

FIG. 2 is a vertical section taken along line II—II of FIG. 1;

FIG. 3 is a section taken along line III—III of FIG. 2;

FIG. 4 is an end view taken from the right in FIG. 2;

FIG. 5 is a bottom view of the arrangement shown in FIG. 2;

Figure 1:
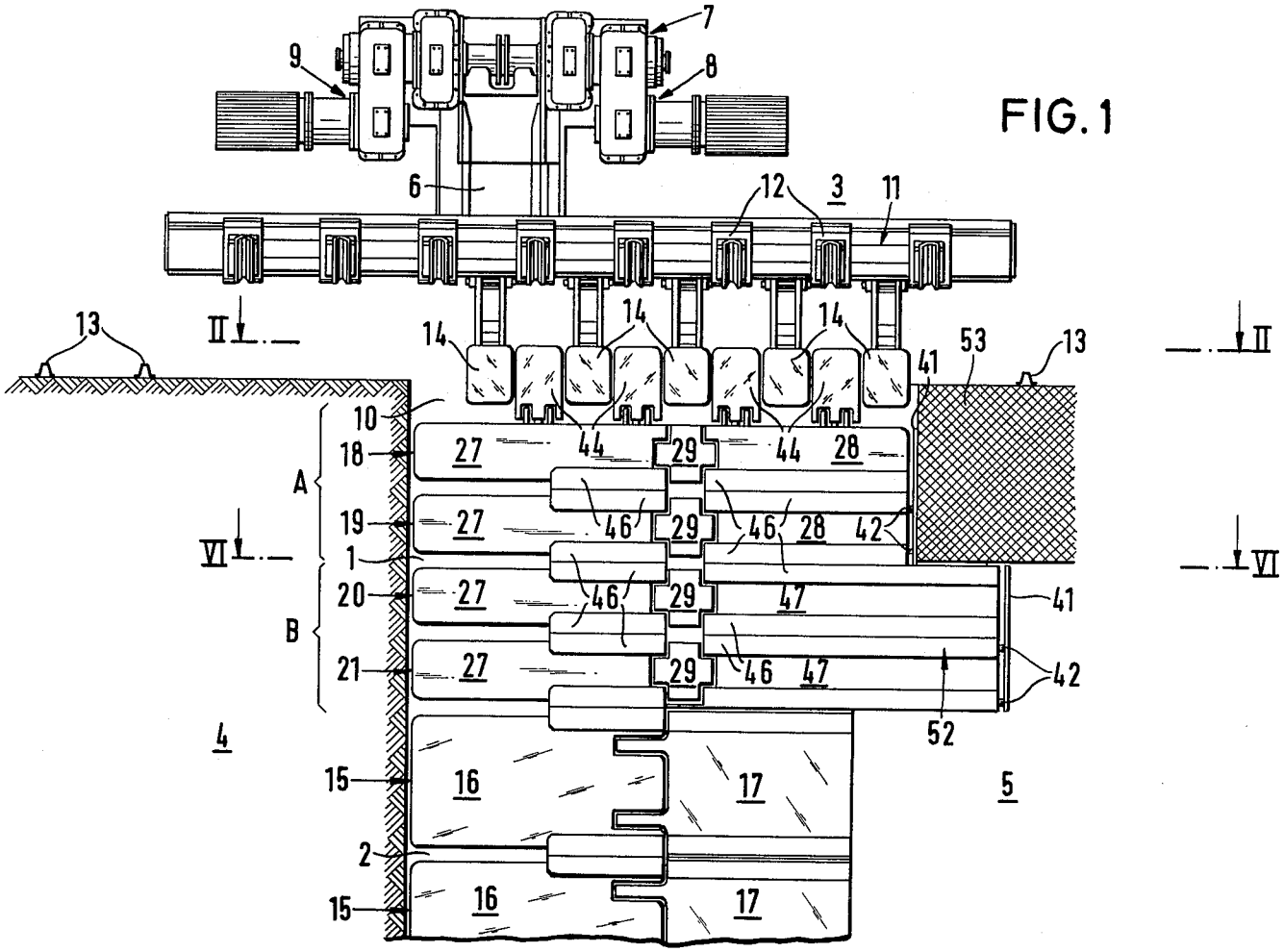
FIG. 1 is a top view of the apparatus according to this invention.

DESCRIPTION OF A PREFERRED EMBODIMENT:

As shown in FIG. 1 a seam-working breast or chamber 1 opens at one side into a mine 3, here a heading extending from a gangway, and on its other side into a region 2. The breast area is defined between a working side 4 from which coal or the like is extracted and a stowage area 5 which is allowed to cave-in or which is filled up with stowage material behind the working area.

A mining apparatus 6 is displaceable along the mine 3 and has a drive head 7 with drive motors 8 and 9 for the mining conveyor 6 and for a mining apparatus which is not shown in detail. This apparatus can comprise a chain saw along with drilling equipment and a coal plow.

At the region 10 where the breast 1 and mine 3 open into each other the roof props supporting the roof of the mine 3 are held up by an apparatus 11 having holders 12 as described in the above-cited copending application. In addition this apparatus 11 has a plurality of upwardly pivotal flaps 14 which are spaced longitudinally apart and serve to support the very edge of the roof of the breast area 1. The legs 13 of the arches that support the roof of the mine 3 can be seen in FIG. 1. These legs 13 are removed as the workings move along the mine, from the right to the left in FIG. 1, and are replaced afterward when the stowage area 5 is filled as shown at 53. Most of the region 2 of the breast 1 is held up by props 15 having roof-engaging plates 16 and shields 17. In the breast region 1 adjacent the mine 3 there are provided two pairs A and B of props 18–21.

FIGS. 2–5 show in more detail the props 18 and 19 of the pair A which each have a floor-engaging base 22 tapering toward the working area 4 and with an upper part 25 vertically displaceable by means of a pair of hydraulic rams 23 and 24 with a lemniscate or rocker linkage 26 provided between each upper part 25 and the respective lower part 22.

Each upper part comprises a main section 28 which is connected via a hinge section 29 to a flap 27. The hinge section 29 is pivoted at one side to the section 27 and at the other side to the section 28. The ram 24 extends vertically between the section 28 and the floor part 22 and the ram 23 extends diagonally from the ram part 22 to the section 27. Thus differential action of these two rams 23 and 24 can tip the flaps 28 and 27 relative to each other. Furthermore a short ram 30 is provided between a lug extending downwardly from the middle of the hinge section 29 and a pivot on the section 28 so that the section 29 can be pivoted relative to the section 28, and of course to the section 27, with corresponding lengthening and shortening of the roof-engaging part 25 and offsetting between the pivot axes at which the sections 27 and 28 are pivoted on the hinge section 29.

The linkage 26 comprises a pair of short links 31 and 32 of different lengths connected to a relatively long link 33 pivoted at its upper end on the section 27. One such linkage 26 is provided on each side of the props 18-21 as best shown in FIG. 4.

Furthermore as shown in FIGS. 3 and 4 the ram 18 is connected to the ram 19 by means of a double-acting hydraulic cylinder 34 having a cylinder part 35 pivoted about a horizontal axis on a lug of the floor-engaging part 22 of the prop 19 and a piston rod 36 connected to a similar such lug 40 on the floor-engaging part 22 of the prop 18. The ram 34 is expansible longitudinally of the two props 18 and 19 and a guide arrangement 37 has a rod passing through an eye 39 in the end of the lug 40 so as to insure parallelism between the two floor-engaging parts 22.

Furthermore the one prop 19 of the pair A, as well as the one prop 21 of the pair B as will be described below, is provided on its upper part 25 at the end of the section 28 with a pivot 42 and on its corresponding lower part 22 with a pivot 43. A telescoping shield 41 extends upwardly between these two pivots 42 and 43 and extends transversely far enough to also cover the corresponding end of the other prop 18. This telescoping shield 41 is comprised of metal plates and, since the upper part 25 is substantially longer, by at least one-third, than the respective lower part 22, overlapping this lower part 22 at both ends, the planar telescoping shield 41 is inclined to the vertical, extending outwardly away from the respective part 22.

In addition the prop 18, which is not directly connected to the shield 41, is provided on the longitudinal side of its upper part 25 with four flaps 44 pivotal about horizontal axes on the sections 27 and 28 and spaced apart by a distance equal to the spacing between adjacent legs 13 of the roof-supporting arches in the mine 3. These plates or flaps 44 are spaced apart by a distance equal to half of the distance between adjacent arches or legs 13 and interleave or mesh with the plates 14. Each plate 44 is controlled by a respective ram 45 capable of displacing it into the position shown in FIG. 4 level with the upper surface of the corresponding upper part 25. Such an arrangement insures very good support of the mine roof at the critical region between the mine 3 and the breast 1. In addition since in accordance with this invention the props 18–21 are stepped as will be described below through a distance equal to the spacing between adjacent arches 13 the flaps 44 need merely be dropped down during such stepping, and will again move up to between the plates 14. The relatively short longitudinal length of these plates 44 insures that there will be no cave-ins during the brief stepping operation.

In addition each of the upper parts 25 is provided with at least one sealing strip is urged by hydraulic elements or by springs toward a corresponding sealing element or bar 46 of an adjacent upper part 25. These strips 46 as seen in FIG. 1 extend in the working region where miners are likely to be underneath the props, so as to protect them from dust and the like falling down through and between the props. Each part 27 and 28 has one such sealing strip 46 of L-section, with the parts 27 and 28 of the prop 18 not provided with such sealing elements on their side carrying the flaps 44.

As shown in FIG. 1 the props 18 and 19 have an overall length which is approximately equal to the open region that is normally left between the breast 1 and the mine 3 and through which the various mining equipment extends. Furthermore each pair A and B has an overall width transverse to its longitudinal direction which is approximately equal to the overall width in the same transverse direction of the shields 15. Thus each prop 18–21 supports a relatively narrow strip so that when one of the props is moved, with its upper part 25 out of engagement with the roof, only a relatively limited area of the roof is unloaded and caving-in is unlikely.

Figure 6:
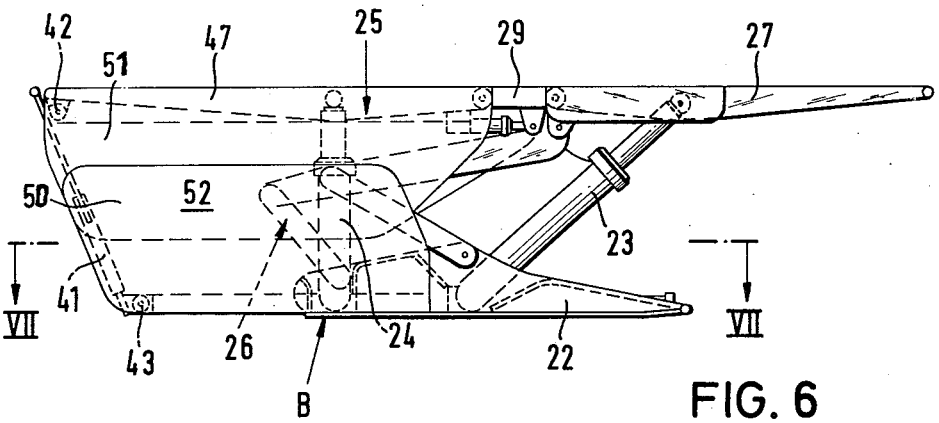
FIG. 6 is a section taken along line VI—VI of FIG. 1.
Figure 7:
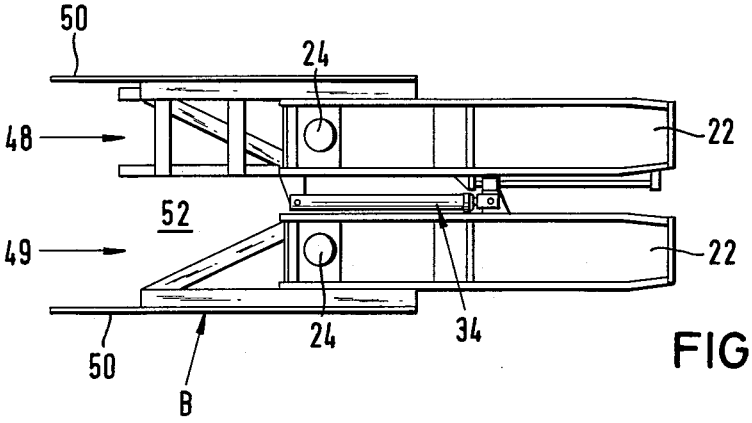
FIG. 7 is a section taken along line VII—VII of FIG. 6.
Figure 8:
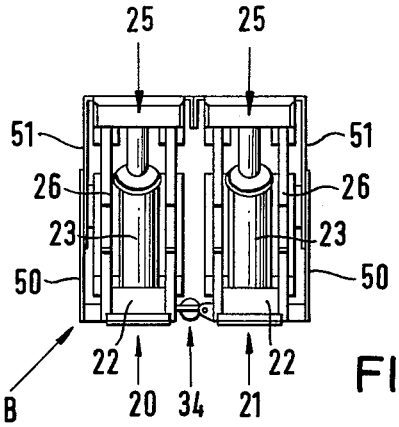
FIG. 8 is an end view taken from the right in FIG. 6.

The principal difference between the props 18 and 19 of the pair A and the props 20 and 21 of the pair B is that the props 20 and 21 have sections 47 corresponding to the sections 28 but considerably longer. Furthermore the floor-engaging parts 22 of these props 20 and 21 as shown in FIGS. 6–8 are provided with rigid framework outriggers 48 and 49 having various crossstruts and members which insure perfect rigidity. These outrigger assemblies 48 and 49 extend longitudinally on the parts 22 under the sections 47. In addition each of these frames 48 and 49 carries a vertical plate 50 which overlaps a similar plate 51 carried on the upper section 47. These two plates 50 and 51 form a further vertical shield which forms together with the shield 41 a closed chamber 52. This chamber 52 constitutes a longitudinal extension at the stowage area and insures that the dust and material in this stowage area will not leak through into the working area. FIG. 1 clearly shows how these side portions will insure that material cannot pass from the stowage side 5 to the breast area 2 even in the regions of overlap between the pair B, the props 15 and the pair A.

With the system according to the present invention it is therefore possible securely and evenly to support the roof of a breast area so as to permit miners and equipment to work safely underneath the overhanging roof. At the same time the stowage area is neatly segregated from the working area so that it is possible to completely shore up the space from which the coal has been removed, otherwise known as the gob, goaf or waste. The stowing material may be any dirt from the seam and from the ripping operation on the roadways, it may also be brought in from the surface. Furthermore it is simply possible to allow the roof to collapse behind the working area. At the same time the possibility of stepping relatively narrow props with respect to one another insures that only a minor portion of the roof is ever unloaded at one time, so that caving-in at the working area is highly unlikely.

It will be understood that each of the elements described above, or two or more together, may also find a useful application in other types of mining systems differing from the types described above.

While the invention has been illustrated and described as embodied in a roof-support for breast in longwall mining operation, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A prop system for supporting the roof of a breast extending laterally from a mine and having a face side at a working area and a stowage side at a stowage area, said system comprising:

at least three similar props one of which is relatively close to said mine, one of which is relatively far from said mine, and one of which is flanked by the other two props, said props each including a lower floor-engaging part elongated longitudinally generally parallel to said mine, a roof-engaging upper part extending generally parallel to the respective lower part and having a pair of opposite ends extending longitudinally past the respective lower part, and means for displacing each upper part vertically relative to the respective lower part;

means extending longitudinally between adjacent props for displacing each prop longitudinally generally parallel to said mine relative to the other props for stepping of said props along said breast parallel to said mine;

an upright and transversely extending solid shield on each of said props extending transversely to said mine between the respective upper and lower parts at the ends thereof turned toward said stowage side; and an upright and longitudinally extending solid shield extending longitudinally generally parallel to said mine between the upper and lower parts of the prop furthest from said mine, said transverse and longitudinal shields together partitoning said stowage area off from said working area.

2. The system defined in claim 1, wherein said prop closest to said mine is provided on its upper part with a plurality of roof-engaging flaps extending toward said mine, and with means for urging said flaps against the roof.

3. The system defined in claim 1, wherein each of said upper parts is formed of a plurality of sections and at least one hinge between said sections.

4. The system defined in claim 1, wherein each of said props further includes means including a linkage for maintaining each of said upper parts generally parallel to the respective lower part.

5. The system defined in claim 1, wherein said system has a plurality of such props, each prop being connected via said means extending longitudinally to the other prop of the respective pair, said means extending longitudinally including hydraulic rams each connected at one end to one prop of a respective pair and at the other end to the other prop of the respective pair.

6. The system defined in claim 1, wherein said other shield is formed by a pair of vertically overlapping plates one of which is secured to the respective upper part and the other of which is secured to the respective lower part.

7. A prop system for supporting the roof of a breast extending laterally from a mine and having a face side and a stowage side, said system comprising:

a plurality of similar props each including a lower floor-engaging part elongated longitudinally generally parallel to said mine, a roof-engaging upper part extending generally parallel to the respective lower part and having a pair of opposite ends extending longitudinally past the respective lower part, each upper part further having a main section, a pivot at the end of said main section closer to said face, and a flap carried on said pivot, means for displacing the respective pivot vertically of the respective main section for varying the shape of the respective upper part, means for pivoting the respective flap about the respective pivot for accommodating irregularly shaped roof, and means for displacing each upper part vertically relative to the respective lower part;

means extending longitudinally between adjacent props for displacing each prop longitudinally relative to the other props;

an upright solid shield on each of said props extending between the respective upper and lower parts at the ends thereof turned toward said stowage side; and another solid shield extending longitudinally between the upper and lower parts of the prop furthest from said mine.

8. The system defined in claim 1, wherein each upper part is provided on its longitudinal side turned toward another upper part with sealing means for preventing dust and the like from descending between adjacent upper parts and comprising a sealing element on each upper part.

9. A prop system for supporting the roof of a breast extending laterally from a mine and having a face side and a stowage side, said system comprising:

a plurality of similar props each including a lower floor-engaging part elongated longitudinally generally parallel to said mine, a roof-engaging upper part extending generally parallel to the respective lower part and having a pair of opposite ends extending longitudinally past the respective lower part, and means for displacing each upper part vertically relative to the respective lower part, said prop closest to said mine being provided on its upper part with a plurality of longitudinally spaced roof-engaging flaps extending toward said mine and with means for urging said flaps against the roof;

means extending longitudinally between adjacent props for displacing each prop longitudinally relative to the other props;

an upright solid shield on each of said props extending between the respective upper and lower parts of the ends thereof turned toward said stowage side; and another upright solid shield extending longitudinally between the upper and lower parts of the prop furthest from said mine.

10. The system defined in claim 9, wherein each of said means for urging includes a hydraulic cylinder between each flap and the respective upper part for displacement of the respective flap into a horizontal position level with the respective upper part.

11. A prop system for supporting a roof of a breast extending laterally from a mine and having a face side at a working area and a stowage side at a stowage area, said system comprising:

at least three similar props one of which is relatively close to said mine, one of which is relatively far from said mine, and one of which is flanked by the other two props, each prop including a lower floor-engaging part elongated longitudinally generally parallel to said mine, an upper roof-engaging part extending generally parallel to the respective lower part and having a pair of opposite ends extending longitudinally past the respective lower part, each upper part being formed of a plurality of sections and at least one hinge between said sections, means including a linkage for maintaining each of said upper parts generally parallel to the respective lower part, and means for displacing all the sections of each upper part vertically relative to the respective lower part and thereby pressing said sections against the roof;

a plurality of roof-engaging flaps on the upper part of the prop closest to said mine extending therefrom toward said mine;

means between said flaps and the respective prop for urging said flaps against the roof;

means extending longitudinally between adjacent props for displacing each prop longitudinally generally parallel to said mine relative to the other props for stepping of said props along said breast parallel to said mine;

an upright and transversely extending solid shield on each of said props extending transversely to said mine between the respective upper and lower parts at the ends thereof turned toward said stowage side; and an upright and longitudinally extending solid shield extending longitudinally generally parallel to said mine between the upper and lower parts of the prop further from said mine, said transverse and longitudinal shields together partitioning said stowage area off from said working area.

* * * * *